US008762063B2

(12) United States Patent
Zhang et al.

(10) Patent No.: US 8,762,063 B2
(45) Date of Patent: Jun. 24, 2014

(54) ANALYZING FLUID WITHIN A CONTEXT

(76) Inventors: Wei Zhang, Houston, TX (US); Christopher M. Jones, Houston, TX (US); Michael T. Pelletier, Houston, TX (US); Robert S. Atkinson, Richmond, TX (US); Stephen A. Zannoni, Houston, TX (US)

( * ) Notice: Subject to any disclaimer, the term of this patent is extended or adjusted under 35 U.S.C. 154(b) by 339 days.

(21) Appl. No.: 13/213,195

(22) Filed: Aug. 19, 2011

(65) Prior Publication Data

US 2013/0046473 A1 Feb. 21, 2013

(51) Int. Cl.
*G06F 19/00* (2011.01)

(52) U.S. Cl.
USPC ..... 702/6; 702/9; 702/11; 702/12; 702/13; 702/45; 73/152.27; 73/152.28

(58) Field of Classification Search
USPC ..... 702/6, 9, 11, 12, 13, 16, 45; 73/152.19, 73/152.18, 152.24, 152.27, 152.55, 73/152.28, 152.42, 152.04, 152.22, 73/152.51, 152.52; 367/31, 50; 175/48, 175/50; 166/250.01, 264, 265
See application file for complete search history.

(56) References Cited

U.S. PATENT DOCUMENTS 4,966,436 A * 10/1990 Mayhew et al. ..... 359/477
5,663,559 A 9/1997 Auzerais et al.
6,032,101 A * 2/2000 Freedman et al. ..... 702/8
6,343,507 B1 * 2/2002 Felling et al. ..... 73/152.19
6,758,090 B2 7/2004 Bostrom et al.
7,305,306 B2 * 12/2007 Venkataramanan et al. ..... 702/9
7,398,159 B2 * 7/2008 Venkataramanan et al. .... 702/11
7,434,457 B2 10/2008 Goodwin et al.
7,461,547 B2 * 12/2008 Terabayashi et al. ..... 73/152.55
7,687,769 B2 3/2010 Indo et al.
7,720,323 B2 5/2010 Yamate et al.
7,788,972 B2 * 9/2010 Terabayashi et al. ..... 73/152.27
7,796,468 B2 * 9/2010 Kellogg ..... 367/31
8,434,356 B2 * 5/2013 Hsu et al. ..... 73/152.18
2002/0194906 A1 12/2002 Goodwin et al.
2006/0155474 A1 * 7/2006 Venkataramanan et al. .... 702/13
2007/0035736 A1 2/2007 Vannufflelen et al.
2007/0255501 A1 * 11/2007 Kellogg ..... 702/16
2009/0306897 A1 12/2009 Dong et al.
2010/0258304 A1 10/2010 Hegeman
2011/0075515 A1 * 3/2011 Lie ..... 367/50

* cited by examiner

*Primary Examiner* — Carol S Tsai
(74) *Attorney, Agent, or Firm* — Howard L. Speight

(57) ABSTRACT

A processor accepts sensor data about a geological formation from a sensor. The sensor data is such that processing the sensor data using a processing technique to estimate a parameter of the geological formation without a constraint, whose value is not yet known, produces a plurality of non-unique estimates of the parameter. The processor accepts more than two time-displaced images of fluid sampled from the geological formation. The time displacements between the images are substantially defined by a mathematical series. The processor processes the images to determine the constraint. The processor processes the sensor data using the processing technique constrained by the constraint to estimate the parameter of the geological formation. The processor uses the estimated parameter to affect the drilling of a well through the geological formation.

20 Claims, 9 Drawing Sheets

ANALYZING FLUID WITHIN A CONTEXT

Analysts examine fluids extracted from geological formations to estimate the properties of the geological formation and the economic value of the fluids being produced. The fluids may be analyzed by formation testing tools that are deep within a well. The fluid being extracted and analyzed may contain contaminants or multiple phases. Analyzing such fluids, and in particular, detecting multiple phases in a fluid and the effect those multiple phases can have on the estimation of properties of the geological formation, can be a challenge.

DETAILED DESCRIPTION

For the purposes of this application, a "phase" of matter is defined as "a homogenous part of a system, separated from other parts by physical boundaries." Linus Pauling, General Chemistry at 9 (Dover Publications 1988). For example, in the context of the fluids in an oil well, oil, gas, and water are different phases. In a system in which a fluid is experiencing laminar flow, each layer of flow is, in one embodiment, considered a phase.

Figure 1:
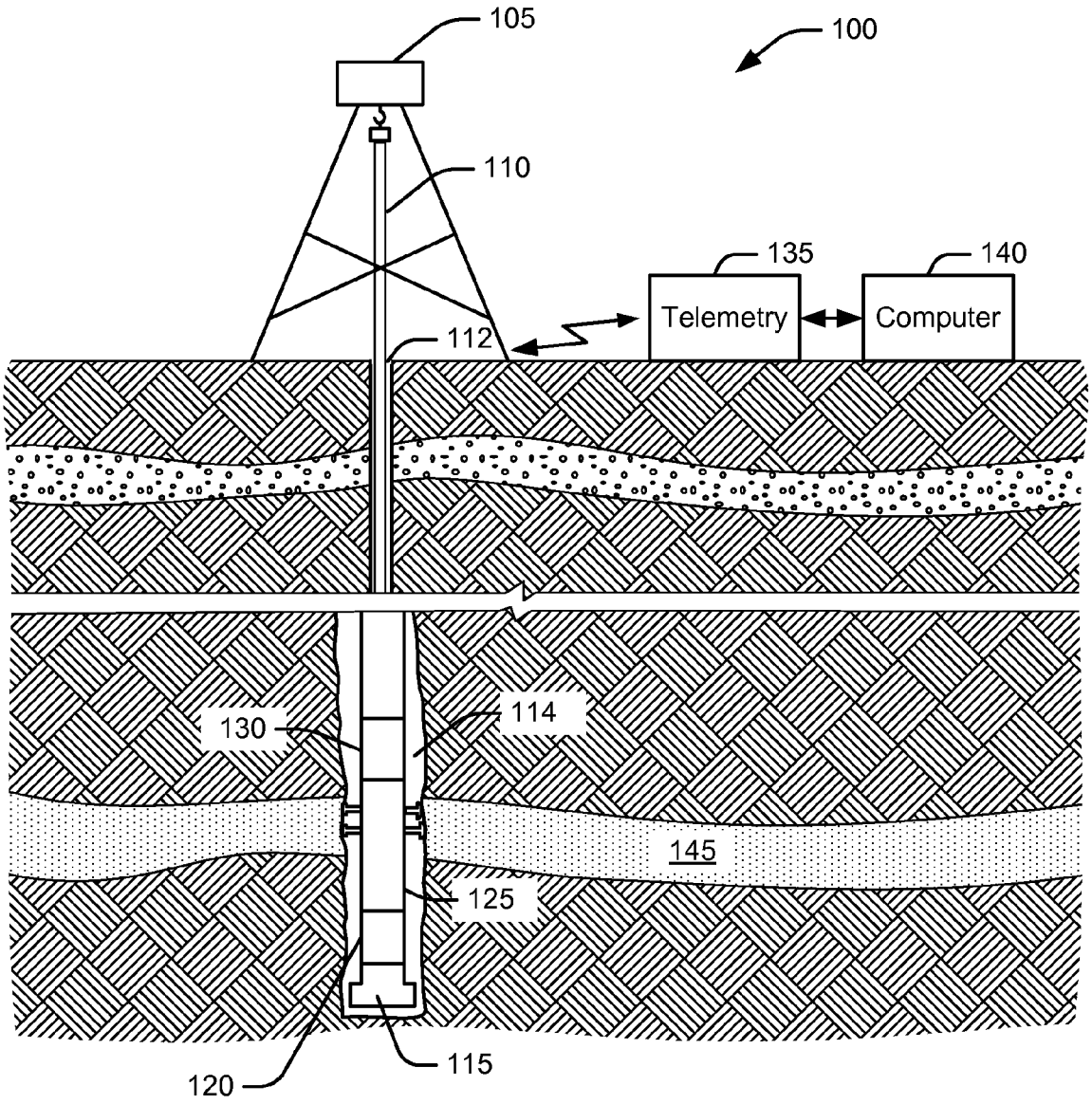
FIG. 1 illustrates a drilling system.

An example environment 100, illustrated in FIG. 1, includes a derrick 105 from which a drill string 110 is suspended in a borehole 112. FIG. 1 is greatly simplified and for clarity does not show many of the elements that are used in the drilling process. In one embodiment, the volume within the borehole 112 around the drill string 110 is called the annulus 114. In one embodiment, the drill string includes a bit 115, a variety of actuators and sensors, shown schematically by element 120, a formation testing tool 125, and a telemetry section 130, through which the downhole equipment communicates with a surface telemetry system 135. In one embodiment, a computer 140, which in one embodiment includes input/output devices, memory, storage, and network communication equipment, including equipment necessary to connect to the Internet, receives data from the downhole equipment and sends commands to the downhole equipment.

The equipment and techniques described herein are also useful in a wireline or slickline environment. In one embodiment, for example, a formation testing tool may be lowered into the borehole 112 using wired drillpipe, wireline, coiled tubing (wired or unwired), or slickline. In one embodiment of a measurement-while-drilling or logging-while-drilling environment, such as that shown in FIG. 1, power for the formation testing tool is provided by a battery, by a mud turbine, through a wired pipe from the surface, or through some other conventional means. In one embodiment of a wireline or slickline environment, power is provided by a battery or by power provided from the surface through the wired drillpipe, wireline, coiled tubing, or slickline, or through some other conventional means.

In one embodiment, the drilling equipment is not on dry land, as shown in FIG. 1 but is in a wetland or at sea. In such an environment, the derrick 105 (or another piece of equipment that performs the function of the derrick) is located on a drilling platform, such as a semi-submersible drilling rig, a drill ship, or a jack-up drilling rig. The drill string 110 extends from the derrick 105 through the water, to the sea floor, and into the formation.

Figure 2:
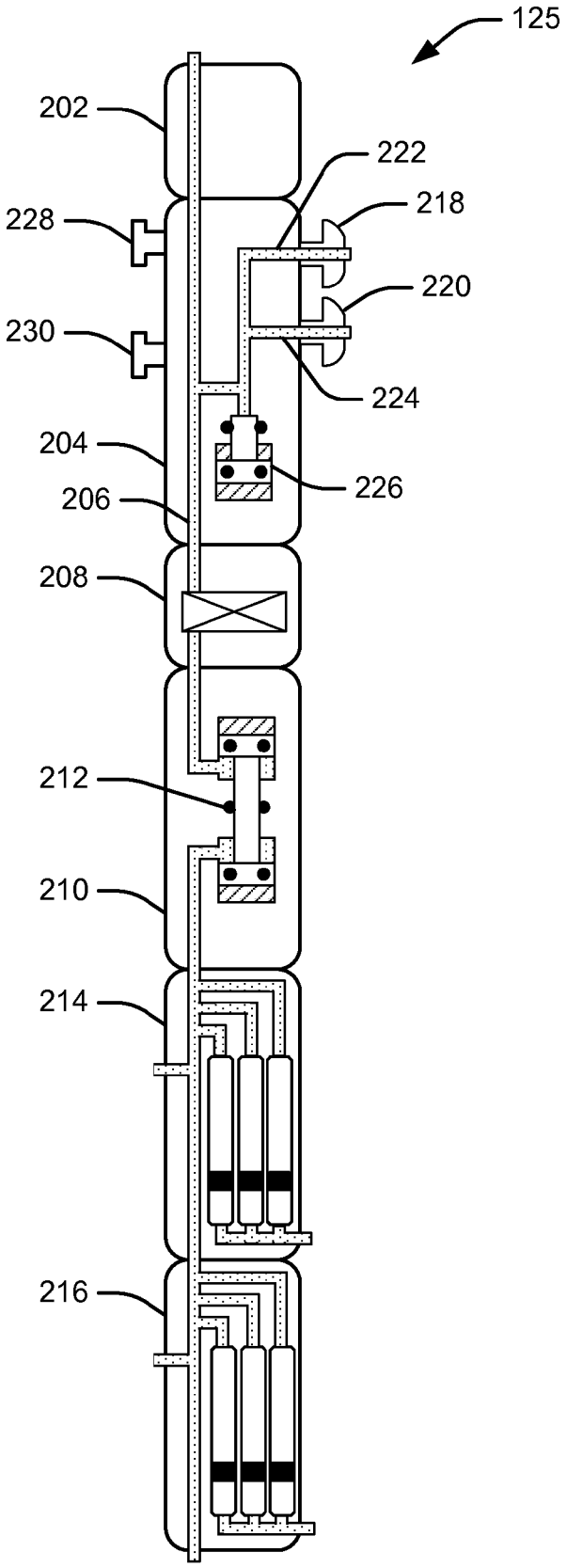
FIG. 2 is a block diagram of a formation testing tool.

A more detailed, but still simplified, schematic of an embodiment of the formation testing tool 125 is shown in FIG. 2. In one embodiment, the formation testing tool 125 includes a power telemetry section 202 through which the tool communicates with other actuators and sensors 120 in the drill string, the drill string's telemetry section 130, and/or directly with the surface telemetry system 135. In one embodiment, the power telemetry section 202 is also the port through which the various actuators (e.g. valves) and sensors (e.g., temperature and pressure sensors) in the formation testing tool 125 are controlled and monitored. In one embodiment, the power telemetry section 202 includes a computer that exercises the control and monitoring function. In one embodiment, the control and monitoring function is performed by a computer in another part of the drill string (not shown) or by the computer 140 on the surface.

In one embodiment, the formation testing tool 125 includes a dual probe section 204, which extracts fluid from the reservoir, and delivers it to a channel 206 that, in one embodiment, extends from one end of the formation testing tool 125 to the other. In one embodiment, the channel 206 can be connected to other tools. In one embodiment, the formation testing tool 125 also includes an analysis section 208, which includes sensors to allow measurement of properties, such as temperature and pressure, of the fluid in the channel 206. In one embodiment, the formation testing tool 125 includes a flow-control pump-out section 210, which includes a high-volume bidirectional pump 212 for pumping fluid through the channel 206. In one embodiment, the formation testing tool 125 includes two multi-chamber sections 214, 216.

In one embodiment, the dual probe section 204 includes two probes 218, 220 which extend from the formation testing tool 125 and press against the borehole wall, as shown in FIG. 1. Returning to FIG. 2, probe channels 222, 224 connect the probes 218, 220 to the channel 206. The high-volume bidirectional pump 212 can be used to pump fluids from the reservoir, through the probe channels 222, 224 and to the channel 206. Alternatively, a low volume pump 226 can be used for this purpose. Two standoffs or stabilizers 228, 230 hold the formation testing tool 125 in place as the probes 218, 220 press against the borehole wall, as shown in FIG. 1. In one embodiment, the probes 218, 220 and stabilizers 228, 230 are retracted when the tool is in motion and are extended to sample the formation fluids.

Figure 3:
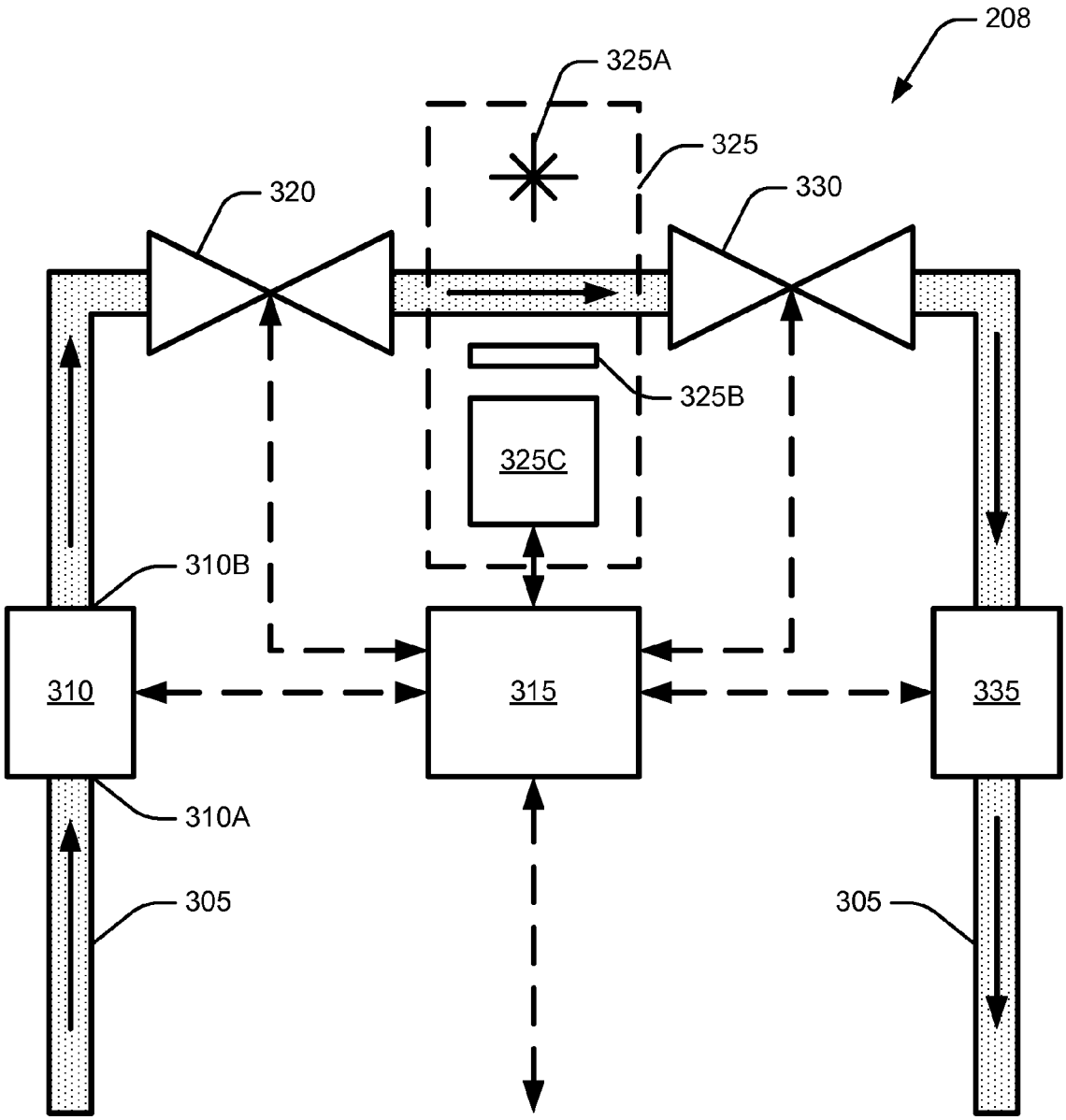
FIG. 3 is a block diagram of an analysis section within a formation testing tool.

One embodiment of the analysis section 208, illustrated in FIG. 3, includes an analysis section channel 305 that connects to the channel 206. The analysis section channel 305 may be in series with the channel 206 or it may be in parallel with the channel 206. In the former case, in one embodiment, all fluids that flow through the channel 206 also flow through the analysis section channel 305. In the latter case, in one embodiment, valves (not shown) at the end of the analysis section channel 305 allow fluids to be sampled from the channel 206 and sent through the analysis section 208.

In one embodiment, fluids flow through the analysis section channel 305 in the direction shown by the arrows in the analysis section channel 305 in FIG. 3.

In one embodiment, the analysis section 208 includes a pump 310 connected in line with the analysis section channel 305. The pump 310 has an inlet side 310A, through which fluids are received by the pump, and an outlet side 310B, through which fluids are expelled by the pump. In one embodiment, the pump 310 operates in the opposite direction. In one embodiment, the pump 310 is reversible. In one embodiment, the pump creates a pressure difference between the fluids on the inlet side 310A and the outlet side 310B. In one embodiment, the amount of the pressure difference can be adjusted. In one embodiment, the pressure difference is controlled by a processor 315.

In one embodiment, the processor 315 is housed within the analysis section 208 and is dedicated to the operation of the analysis section 208. In one embodiment, the processor 315 is a processor in another part of the drill string (not shown). In one embodiment the processor 315 is the processor 140 on the surface. In one embodiment, the processor 315 is a microprocessor. In one embodiment, the processor 315 is a microcontroller. In one embodiment, the processor 315 is a programmable logic array. In one embodiment, the processor 315 is formed from discrete logic elements.

In one embodiment, the analysis section 208 includes an inbound choke valve 320 that, under the control of the processor 315, variably restricts or cuts off the flow of fluids.

In one embodiment, the analysis section 208 includes an optical subsystem 325. In one embodiment, the optical subsystem includes a light source 325A, an optical mask 325B, and an imaging device 325C. In addition, in one embodiment, the analysis section channel 305 includes windows made of a material, such as sapphire, that is at least partially transparent to the light omitted by the light source 325A. Consequently, light emitted by the light source 325A passes through the analysis section channel 305, through any fluid flowing through the analysis section channel 305, through the optical mask 325B, and is imaged by the imaging device 325C. In one embodiment, a second optical mask (not shown) is placed between the light source 325A and the analysis section channel 305.

In one embodiment, the light source 325A emits light in the infra-red spectrum. In one embodiment, the light source 325A emits light in the visible spectrum. In one embodiment, the light source 325A emits light in the ultra-violet spectrum. In one embodiment, the light source 325A can emit light over all, or some subset of all, of these ranges. In one embodiment, the frequency range of the light emitted by the light source 325A is controllable by the processor 315.

In one embodiment, the optical mask 325B is a piece of hardware. In one embodiment, the optical mask 325B is controlled by the processor 315. In one embodiment, the optical mask is software or firmware executed by the processor 315. In one embodiment, the optical mask is a multivariate optical element ("MOE") capable of performing spectroscopy on the light emitted by the light source 325A and transmitted through the fluids passing through the analysis section channel 305.

In one embodiment, the optical mask 325 includes pattern recognition capabilities. In one embodiment, the optical mask can use the pattern recognition capabilities to detect bubbles, particles of sand or other contaminants in the fluid, differences in phases in the fluids, and other similar patterns.

In one embodiment, the optical mask 325 includes a holographic filter that provides high attenuation over a narrow bandwidth.

In one embodiment, the optical mask 325 provides enhanced phase detection and enhanced inhomogeneity detection. In one embodiment, the optical mask 325 includes a filter, a cross polarizer, and/or a Moiré filter.

In one embodiment, the imaging device 325C is a camera that is capable of operating at the high temperatures (in excess of 200 degrees Centigrade) encountered in the drilling environment. In one embodiment, the imaging device 325C includes a thermopile array, such as that manufactured by Heimann Sensor GmbH, Memstech, and Devantech.

In one embodiment, the processor 315 controls the imaging device 325C and receives and processes images from the imaging device 325C.

In one embodiment, the analysis section 208 includes an outbound choke valve 330 that, under the control of the processor 315, variably restricts or cuts off the flow of fluids. In one embodiment, the processor 315 controls and optionally receives status from the outbound choke valve 330 and the inbound choke valve 320.

In one embodiment, the analysis section 208 includes an instrument package 335 that includes one or more of a temperature sensor to measure the temperature of fluids flowing through the analysis section channel 305, a pressure sensor to measure the pressure in the fluid flowing through the analysis section channel 305, and other similar sensors.

While FIG. 3 shows a particular arrangement of the components in the analysis section 208, it will be understood that the components can be placed in different configurations and orders. For example, in one embodiment the instrument package 335 is placed between the optical subsystem 325 and the outbound choke valve 330. In one embodiment, one of the inbound choke valve 320 and the outbound choke valve 330 is not present.

Figure 4:
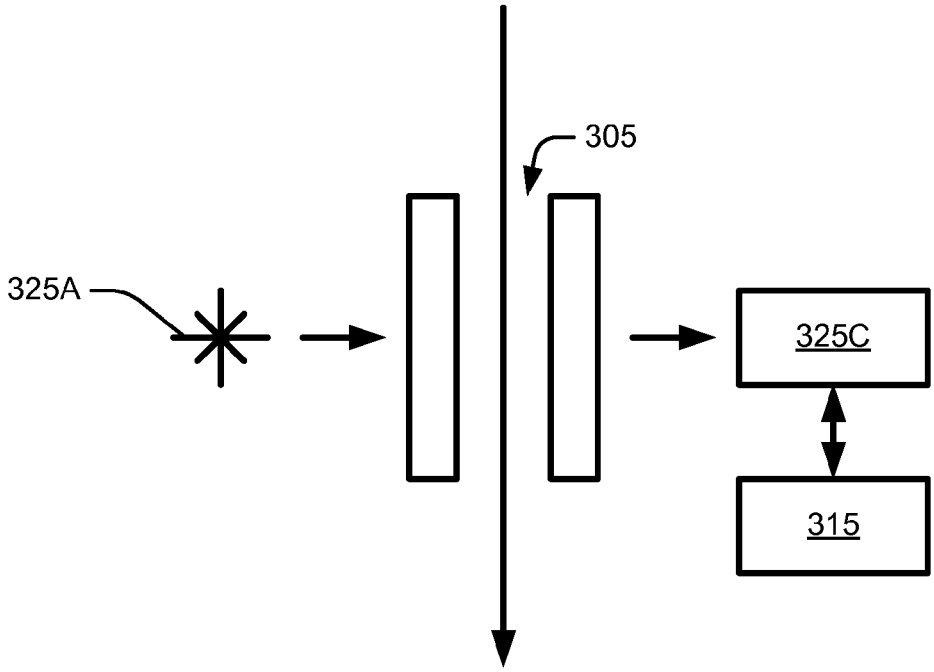
FIGS. 4-10 are block diagrams of imaging devices.
Figure 5:
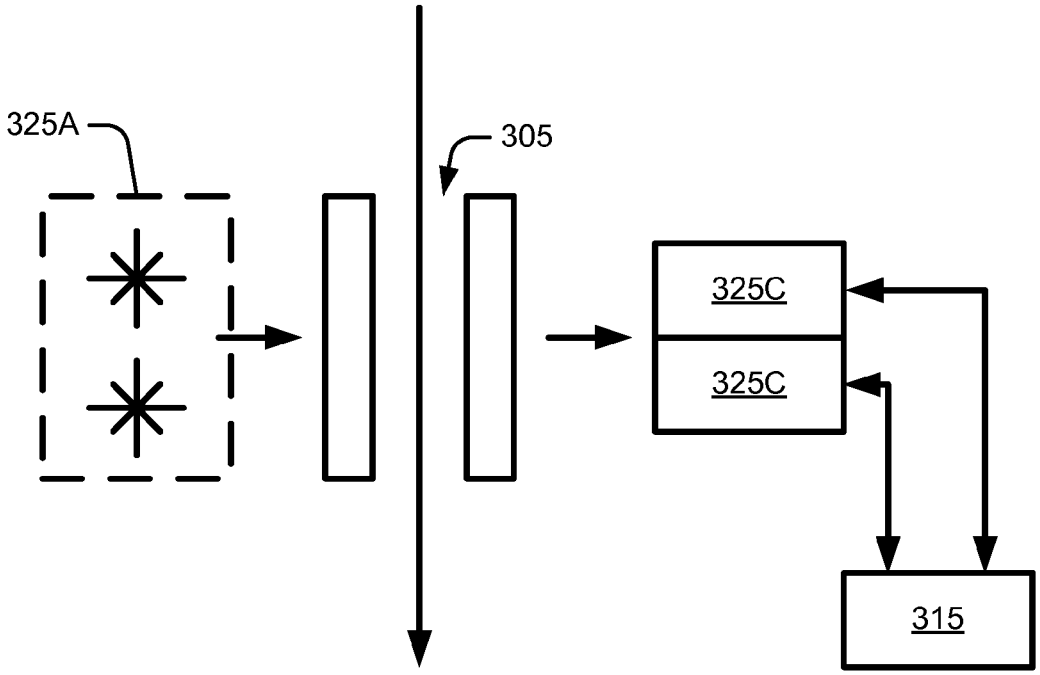
Figure 6:
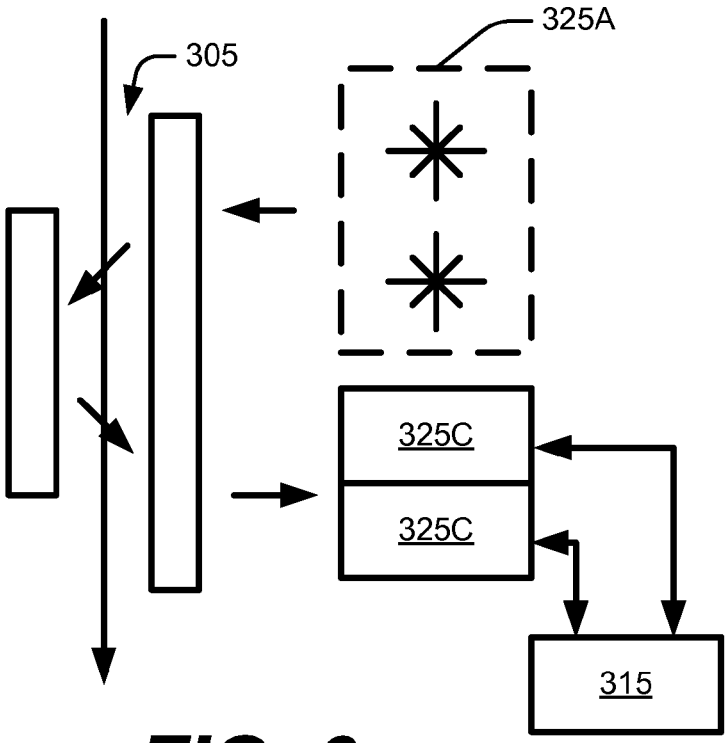
Figure 7:
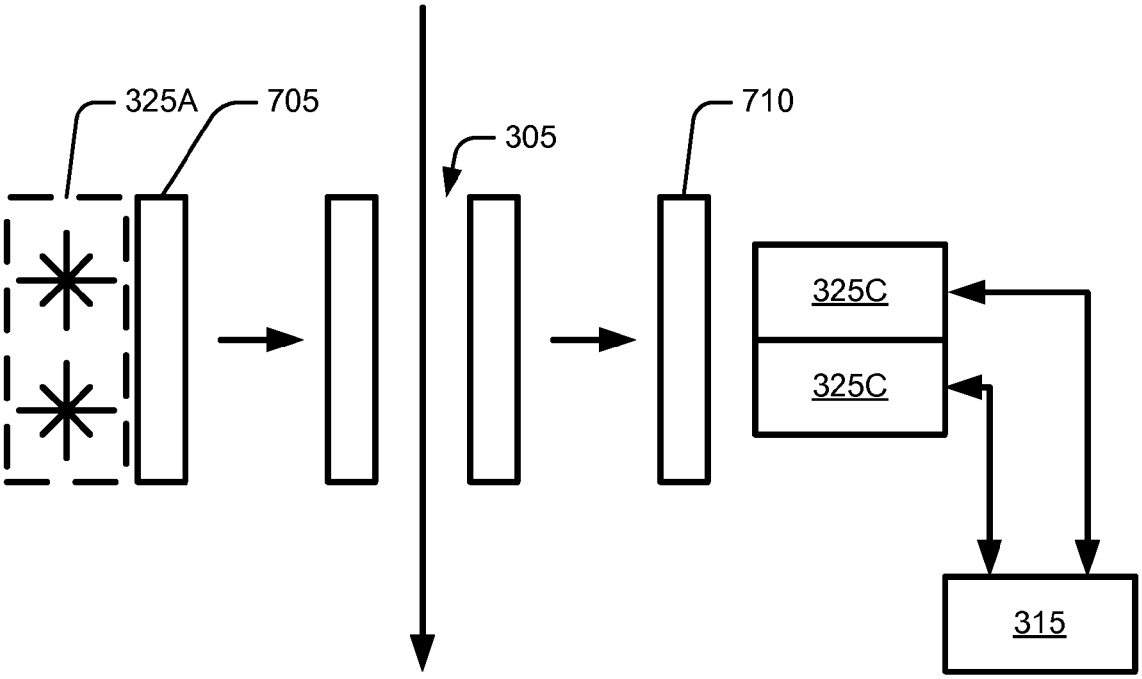

In one embodiment, illustrated in FIG. 4, the light source 325A is a single light source, and the imaging device 325C is a single imaging device, such as a camera or a thermopile array. In one embodiment, illustrated in FIG. 5, the light source 325A consists of two (or more) sources of light, each source covering a different frequency range (e.g., visible and infra-red, or infra-red and ultra-violet, etc.), and the imaging device 325C includes two (or more) imaging devices, one sensitive to one frequency range and the other sensitive to another frequency range. In one embodiment, illustrated in FIG. 6, the light source 325A consists of two sources of light and the imaging device 325C is as discussed with respect to FIG. 5. In the embodiment shown in FIG. 6, the light source 325A is on the same side of the analysis section channel 305 and the light reflects off a mirrored surface that is either part of a wall of the analysis section channel 305 or is separate from and outside the analysis section channel 305. In one embodiment, illustrated in FIG. 7, the light source 325A includes two sources of light and the imaging device 325C consists of two imaging devices, as discussed with respect to FIG. 5, and two optical masks 705, 710 are present.

Figure 8:
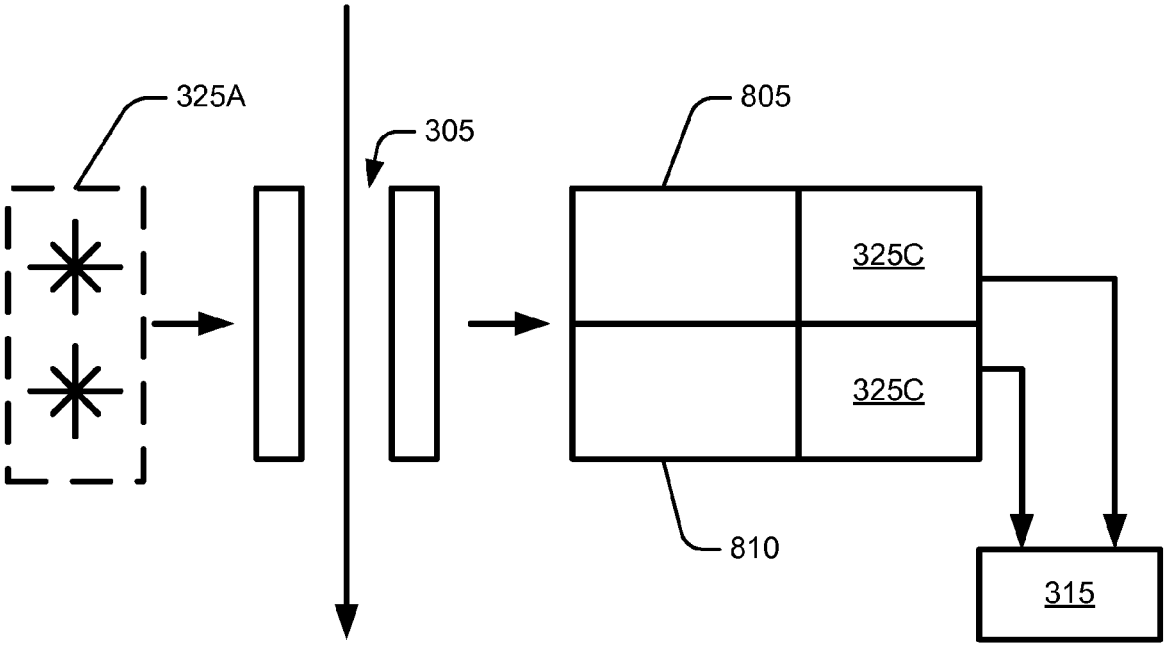
Figure 9:
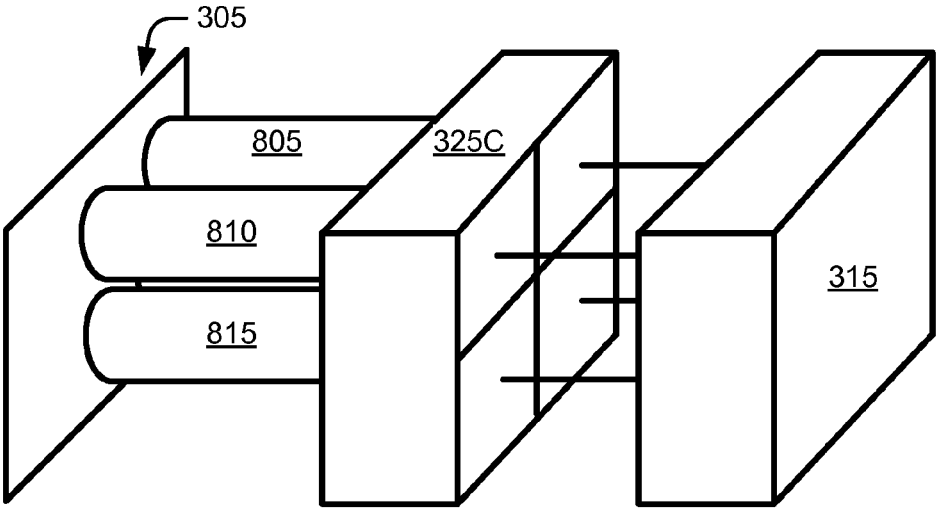

In one embodiment, shown in FIG. 8, light pipes 805, 810 carry light from the analysis section channel 305 to the imaging device 325C. In one embodiment, shown in FIG. 9, the imaging device 325C includes a large number (only four are shown) of imaging devices and a large number (only three are shown) of light pipes 805, 810, 815 to convey light from the analysis section channel 305 to the imaging device 325C.

Figure 10:
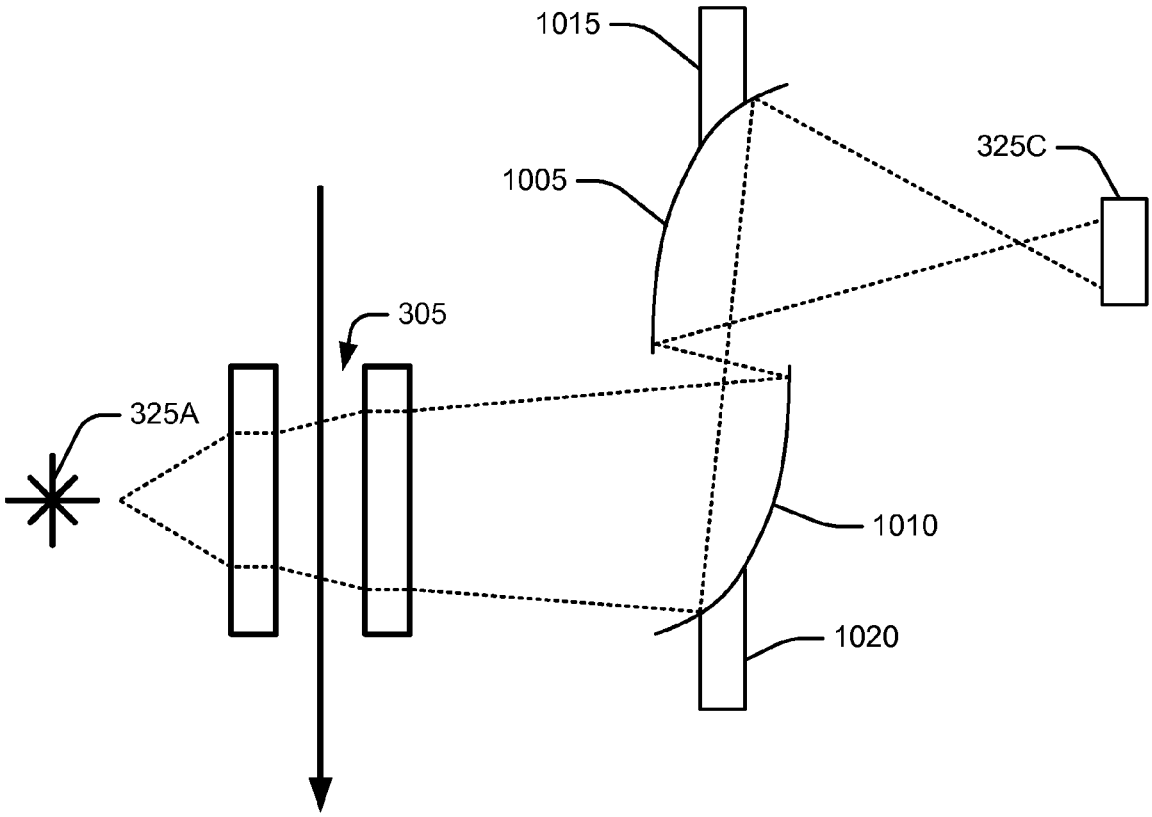

In another arrangement for collecting images, illustrated in FIG. 10, parabolic reflecting mirrors 1005 and 1010 collect the light from the light source 325A and direct it to the imaging device 325C. The parabolic reflecting mirrors 1005 and 1010 are designed so that each compensates for the deformations that the other will experience because of heat in the down-hole data collection locations. Further, the mounts 1015 and 1020 are designed so that each offsets heat-caused distortions to the other.

In one embodiment, the collected images are a series of a plurality of substantially-equally-spaced images. In one embodiment, the collected images include more than 2 images. In one embodiment, the collected images include more than 10 images. In one embodiment, the collected images include more than 100 images. In one embodiment, each image is of light detectable in the visible light spectrum. In one embodiment, each image is of light detectable in the infra-red spectrum. In one embodiment, each image is of light detectable in the ultra-violet spectrum. In one embodiment, each image is of light detectable in the infra-red, visible, and ultra-violet spectrums.

Figure 11:
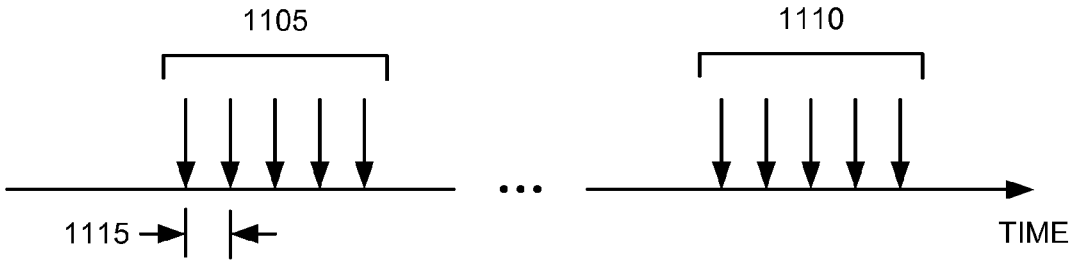
FIG. 11 is a diagram illustrating the timing of images taken by an imaging device.

In one embodiment, illustrated in FIG. 11, the series of images is collected at substantially equally intervals. FIG. 11 shows two sets 1105 and 1110 of five images being collected over a period of time. The interval 1115 between the collection images (only one such interval is labeled) is substantially (i.e., in one embodiment within 10 percent, in one embodiment within 5 percent, in one embodiment within 1 percent) the same. In one embodiment, the rate at which the images are collected is similar to the frames per second ("FPS") specification that is associated with video cameras. In one embodiment, the images are collected at a rate on the order of 50 or 60 images per second. While two sets 1105 and 1110 of 5 images are shown being collected in FIG. 11, it will be understood that the number of sets and the number of images per set can be much larger than shown. Further, it will be understood that the images can be taken continuously, rather than in discrete sets as shown.

In one embodiment, the series of images is collected at intervals that can be defined by a linear series, such as that shown in FIG. 11. That is, in one embodiment, the times at which the images are collected are defined by the following equation:

$$t_n = n \cdot i;\ n = 1 \ldots m$$

where:

$t_n$ is the times at which the images are collected;

i is the time interval (or time displacement) between the times that images are collected;

m is the number of images collected in a segment; and n is an index.

In one embodiment, the series of images is collected at intervals that can be defined by a non-linear series. That is, in one embodiment, the times at which the images are collected are defined by the following equation:

$$nlt_n = f(n);\ n = 1 \ldots m$$

where:

$nlt_n$ is the times at which the images are collected;

m is the number of images collected in a segment;

n is an index; and f(n) is an non-linear non-random function.

For example, in one embodiment, the times at which the images are collected are defined by the following equation:

$$nlt_n = i^n;\ n = 1 \ldots m$$

where:

$nlt_n$ is the times at which the images are collected;

m is the number of images collected in a segment;

n is an index; and i is a constant (e.g., "2").

In this example, if:

i=2 and m=5, the times at which the images are collected are:

$nlt_1 = 2$;

$nlt_2 = 4$;

$nlt_3 = 8$;

$nlt_4 = 16$; and $nlt_5 = 32$.

In the linear example, the time displacement between samples is the same. In the non-linear example, the time displacement between samples is defined by the non-linear function. That is, in the example just given, the time displacement between $nlt_1$ and $nlt_2$ is 2 seconds, the time displacement between $nlt_2$ and $nlt_3$ is 4 seconds, the time displacement between $nlt_3$ and $nlt_4$ is 8 seconds, and the time displacement between $nlt_4$ and $nlt_5$ is 16 seconds.

It will be understood that f(n) can be any non-linear non-random function. It will be understood that multiple segments of images can be collected or that a given segment can include a very large number of images. It will also be understood that the images can be collected at times substantially equal to $t_n$ and $nlt_n$, where "substantially equal" in this context is defined to mean, in one embodiment, within 10 percent of the most recent interval, in another embodiment, within 20 percent of the most recent interval, and in another embodiment, within 50 percent of the most recent interval.

Figure 12:
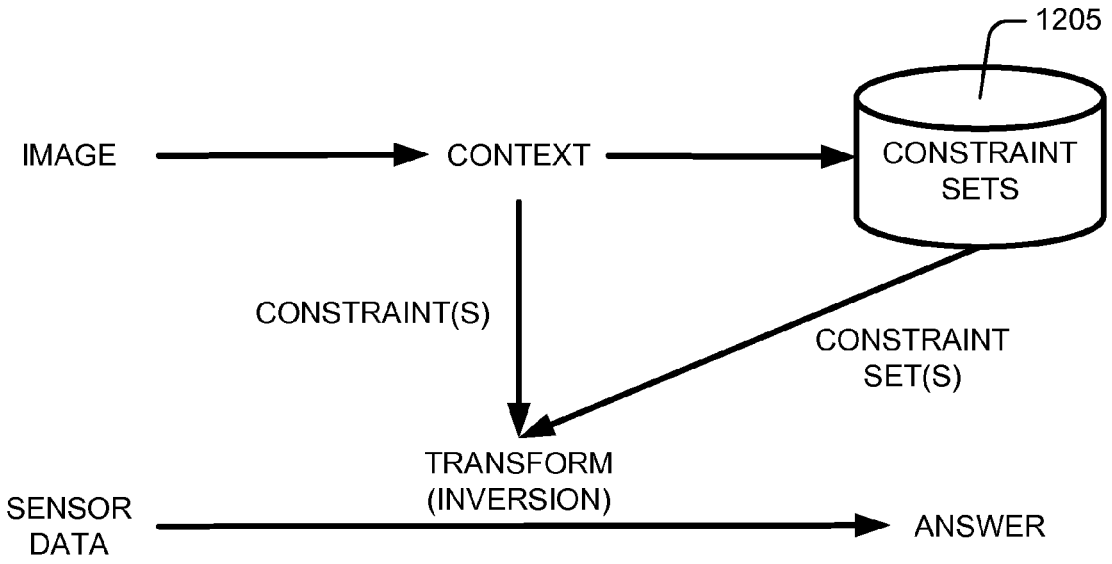
FIG. 12 is a data flow diagram of a system that analyzes fluid within a context.

The images collected by the optical subsystem 325 are used to identify a context which constrains a transformation or inversion of the data collected by other sensors into an answer, as illustrated in FIG. 12. In one embodiment, the images are used to identify a constraint set from a database of constraint sets 1205. For example, in one embodiment, the database of constraint sets 1205 includes entries that correspond to fluids with various sizes and densities of particulate matter in a fluid. The entries in the database of constraint sets 1205 would include constraints that would be used to constrain the transform or inversion.

As can be seen at the bottom of FIG. 12, sensor data is transformed or inverted to produce an answer. For example, U.S. Pat. No. 7,434,457 to Goodwin, et al. (hereinafter "Goodwin") describes measuring the resonant frequency of a movable element immersed in a fluid. The use of the resonant frequency to determine the density and viscosity of the fluid is an example of a "transform" or "inversion" as used in this application. See Goodwin at col. 4, lines 52-55. Goodwin's transformation uses "constants c and k" that are "determined by calibrating the sensor using fluids of known density and viscosity." Id. at col. 4, lines 37-40.

In one embodiment, the images collected by the optical subsystem 325 are used to identify a context in which a transform, such as the transform described in Goodwin, is to operate. A context is defined to be a set of conditions that cause a transform to change or be constrained. For example, the transform in Goodwin may have one set of constants for use when the fluids being measured are a single phase, i.e., free of laminar flow and contaminants. A second set of constants may be used when the fluid is experiencing laminar flow. A third set of constants may be used when the fluid contains gas. A fourth set of constants may be used when the fluid contains solid particles, such as sand. The conditions of the fluid being measured are the contexts. The images collected by the optical subsystem 325 are used to identify the context and thereby constrain the transform to produce an accurate answer.

Figure 13:
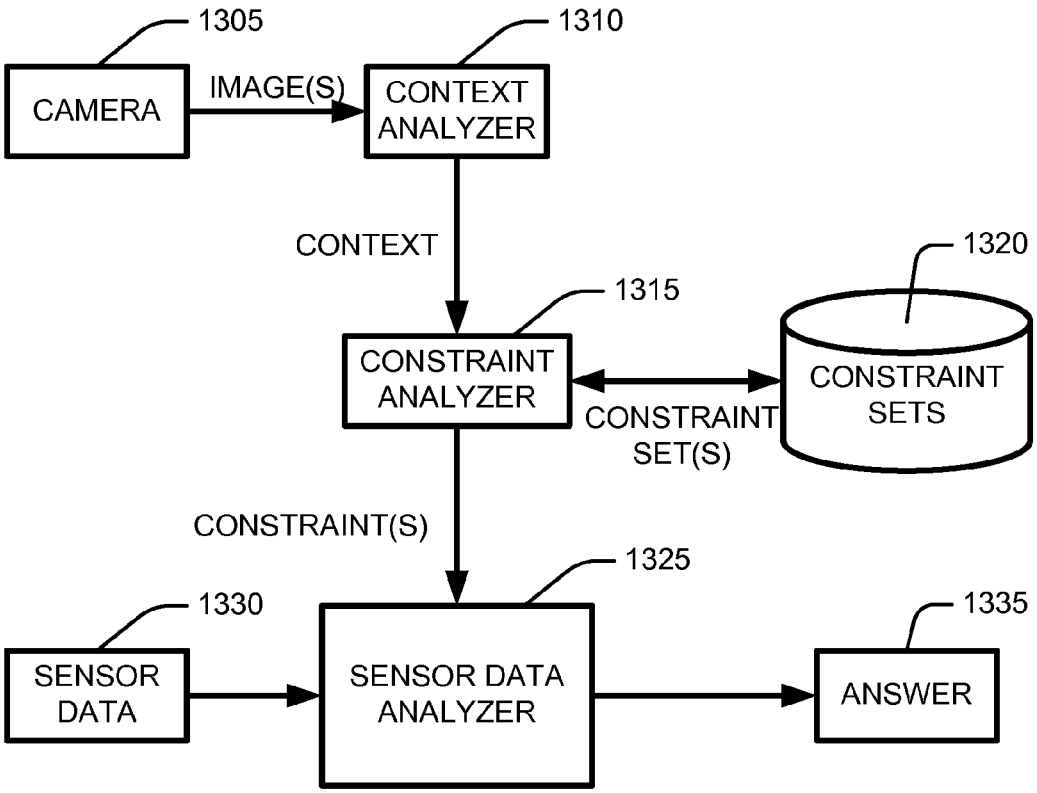
FIG. 13 is a block diagram of a system that analyzes fluid within a context.

One embodiment of a system to perform such an analysis, illustrated in FIG. 13, includes a camera 1305, which in one embodiment is a device such as one of those shown in FIGS. 4-10. In one embodiment, images from the camera 1305 are used by a context analyzer 1310 to identify a context. In one embodiment, the context analyzer 1310 is a function performed by the processor 315. In one embodiment, the context analyzer 1310 is performed by a processor that is separate from processor 315 but that communicates with processor 315 in order to perform some or all of the operations associated with collecting images. In one embodiment, the function of the context analyzer 1310 is performed by a processor in another part of the drill string (not shown). In one embodiment the function of the context analyzer 1310 is performed by the processor 140 on the surface.

In one embodiment, the context analyzer 1310 provides a context to a constraint analyzer 1315. In one embodiment, the function of the constraint analyzer 1315 is performed by a processor dedicated to that task. In one embodiment, the function of the constraint analyzer 1315 is performed by the same processor that performs the function of the context analyzer 1310. In one embodiment, the function of the constraint analyzer 1315 is performed by a processor in another part of the drill string (not shown). In one embodiment the function of the constraint analyzer 1315 is performed by the processor 140 on the surface. In one embodiment, the function of the constraint analyzer 1315 is to identify a set of one or more constraints to be applied to a transform or inversion given the context provided by the context analyzer 1310. In one embodiment, the constraint analyzer 1315 identifies constraints through an analysis of the context. In one embodiment, the constraint analyzer 1315 identifies a constraint set or sets by accessing a database or file of constraint sets 1320 that provides constraint set(s) when queried by context. In one embodiment, the database or file of constraint sets 1320 that provides constraint set(s) when queried using the images provided to the context analyzer 1310.

In one embodiment, the constraint set or sets is provided by the constraint analyzer 1315 to a sensor data analyzer 1325, which uses the constraint set or sets to modify a transform or inversion of sensor data 1330 to produce an answer 1335.

In one embodiment, the context analyzer 1310 identifies a context that includes phase change conditions. In one embodiment, pressure on fluid flowing through the analysis section channel 305 can be controlled using inbound choke valve 320 or outbound choke valve 330. In one embodiment, a bubble point for a fluid flowing through the analysis section channel 305 is identified by lowering the pressure until bubbles are identified in the images provided by the imaging device 325C (e.g., camera 1305). Further, in one embodiment, asphaltene onset pressure for a fluid flowing through the analysis section channel 305 is identified by lowering pressure on the fluid until asphaltene particles are identified in the fluid.

In one embodiment, a dew point in a transparent fluid flowing through the analysis section channel 305 is identified by lowering pressure on the fluid until the images produced by the imaging device 325C are generally black, indicating that the dew point has been reached. Increasing the pressure causes the images to clear up and two phases to be present: (1) a gas, and (2) an oily liquid. In one embodiment, adhesion of droplets to the window into the analysis section channel 305 hint at wetability and hence phase (oily or aqueous) of the fluid.

In one embodiment, the optical mask 325B is a light polarizing filter on both sides of the analysis section channel 305. In one embodiment, the light polarizing filter allows the enhanced detection of solids, including hydrates and salts precipitating from the aqueous phase. In one embodiment, waxes are detected in the oily phases as pinpoints of bright light. In one embodiment, the light polarizing filters act as illumination intensity controls. In one embodiment, mineral solids are highly enhanced in polarized systems.

Figure 14:
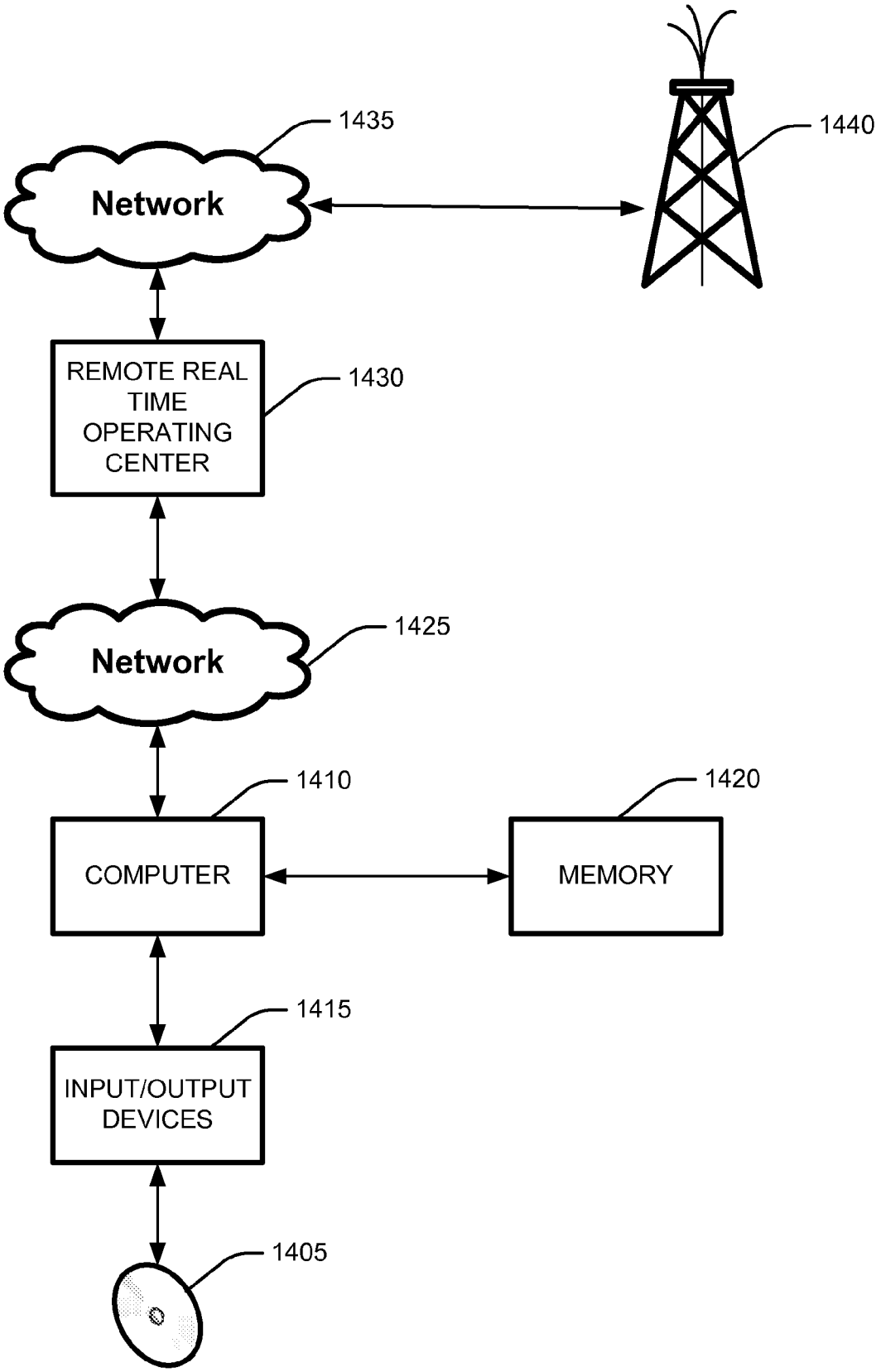
FIG. 14 is a block diagram of a system that includes a remote operating system.

In one embodiment, the perforating system is controlled by software in the form of a computer program on a computer readable media 1405, such as a CD or DVD, as shown in FIG. 14. In one embodiment a computer 1410, which may be the same as or included in the processor 315 (see FIG. 3) or may be the computer 140 on the surface (see FIG. 1), reads the computer program from the computer readable media 1405 through an input/output device 1415 and stores it in a memory 1420 where it is prepared for execution through compiling and linking, if necessary, and then executed. In one embodiment, the system accepts inputs through an input/output device 1415, such as a keyboard, and provides outputs through an input/output device 1415, such as a monitor or printer. In one embodiment, the system stores the results of calculations in memory 1420 or modifies such calculations that already exist in memory 1420.

In one embodiment, the results of calculations that reside in memory 1420 are made available through a network 1425 to a remote real time operating center 1430. In one embodiment, the remote real time operating center 1430 makes the results of calculations available through a network 1435 to help in the planning of oil wells 1440 or in the drilling of oil wells 1440.

The word "coupled" herein means a direct connection or an indirect connection.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method comprising:

a processor accepting sensor data about a geological formation from a sensor, the sensor data being such that processing the sensor data using a processing technique to estimate a parameter of the geological formation without a constraint, whose value is not yet known, produces a plurality of non-unique estimates of the parameter;

the processor accepting more than two time-displaced images of fluid sampled from the geological formation, wherein the time displacements between the images are substantially defined by a mathematical series;

the processor processing the images to determine the constraint;

the processor processing the sensor data using the processing technique constrained by the constraint to estimate the parameter of the geological formation; and the processor using the estimated parameter to affect the drilling of a well through the geological formation.

2. The method of claim 1 wherein the mathematical series is a linear series.

3. The method of claim 1 wherein the mathematical series is a non-linear series.

4. The method of claim 1 wherein processing the images to determine a constraint comprises:

lowering the pressure on the fluid until bubbles can be discerned in the images and using the pressure at which the bubbles were discerned to calculate the bubble point of the fluid.

5. The method of claim 1 wherein processing the images to determine a constraint comprises:

lowering the pressure on the fluid until asphaltene particles can be discerned in the images and using the pressure at which the bubbles were discerned to calculate the asphaltene onset point of the fluid.

6. The method of claim 1 wherein processing the images to determine a constraint comprises:

lowering the pressure on the fluid until the images turn generally black and using the pressure at which the images turn generally black to calculate the dew point of the fluid.

7. The method of claim 1 wherein processing the images to determine a constraint comprises:

adjusting polarizing filters to enhance the detection of solids in the fluid.

8. A computer program stored in a non-transitory tangible computer readable storage medium, the program comprising executable instructions that cause a computer to:

accept sensor data about a geological formation from a sensor, the sensor data being such that processing the sensor data using a processing technique to estimate a parameter of the geological formation without a constraint, whose value is not yet known, produces a plurality of non-unique estimates of the parameter;

accept more than two time-displaced images of fluid sampled from the geological formation, wherein the time displacements between the images are substantially defined by a mathematical series;

process the images to determine the constraint;

process the sensor data using the processing technique constrained by the constraint to estimate the parameter of the geological formation; and use the estimated parameter to affect the drilling of a well through the geological formation.

9. The computer program of claim 8 wherein the mathematical series is a linear series.

10. The computer program of claim 8 wherein the mathematical series is a non-linear series.

11. The computer program of claim 8 wherein when processing the images to determine a constraint, the computer:

lowers the pressure on the fluid until bubbles can be discerned in the images and using the pressure at which the bubbles were discerned to calculate the bubble point of the fluid.

12. The computer program of claim 8 wherein when processing the images to determine a constraint, the computer:

lowers the pressure on the fluid until asphaltene particles can be discerned in the images and using the pressure at which the bubbles were discerned to calculate the asphaltene onset point of the fluid.

13. The computer program of claim 8 wherein, when processing the images to determine a constraint, the computer:

lowers the pressure on the fluid until the images turn generally black and using the pressure at which the images turn generally black to calculate the dew point of the fluid.

14. The computer program of claim 8 wherein, when processing the images to determine a constraint, the computer:

adjusts polarizing filters to enhance the detection of solids in the fluid.

15. An apparatus comprising:

an analysis section that produces time-displaced images, wherein the time displacements between the images are substantially defined by a mathematical series;

an analyzer coupled to the analysis section that analyzes the images to produce a constraint; and a sensor data analyzer that performs an analysis of sensor data, the analysis constrained by the constraint, to produce an answer.

16. The apparatus of claim 15 wherein the analyzer comprises:

a context analyzer coupled to the analysis section that analyzes the images to produce a context; and a constraint analyzer that analyzes the context to produce the constraint.

17. The apparatus of claim 16 further comprising:

a database of constraint sets accessed by the constraint analyzer using the context when producing the constraint.

18. The apparatus of claim 15 wherein the analysis section comprises:

a channel through which a fluid flows;

an optical subsystem comprising:

a light source;

an optical mask; and an imaging device positioned relative to the light source such that light emitted by the light source passes through the channel, the fluid, and the optical mask before it reaches the imaging device.

19. The apparatus of claim 18 further comprising:

a choke valve in the channel that can be controlled to increase or decrease the pressure in the fluid by variable adjusting the amount that the choke valve is open.

20. The apparatus of claim 18 further comprising:

a processor to control the light source, the optical mask, the imaging device, and the choke valve.

* * * * *